US005102129A

United States Patent [19]

Roberts

[11] Patent Number: 5,102,129

[45] Date of Patent: Apr. 7, 1992

[54] GAME APPARATUS

[76] Inventor: Neil H. Roberts, 621 Park Ave., Pocatello, Id. 83201

[21] Appl. No.: 699,639

[22] Filed: May 14, 1991

[51] Int. Cl.[5] ..... A63B 67/00

[52] U.S. Cl. ..... 273/57.1; 273/239

[58] Field of Search ..... 273/57.1, 239

[56] References Cited

U.S. PATENT DOCUMENTS

| | | | |
|---|---|---|---|
| 1,155,273 | 9/1915 | Quade | 273/57.1 |
| 3,136,545 | 6/1964 | Stokes | 273/57.1 |
| 3,226,118 | 12/1965 | Nehl | 273/57.1 |
| 3,515,385 | 6/1970 | Gunderson | 273/57.1 |
| 3,768,809 | 10/1973 | Ciarfello | 273/57.1 |
| 4,021,042 | 5/1977 | Sweeton | 273/239 |
| 4,034,980 | 7/1977 | Sniderman | 273/239 |
| 4,185,819 | 1/1980 | Hartley | 273/57.1 |

*Primary Examiner*—William H. Grieb

*Attorney, Agent, or Firm*—Leon Gilden

[57] ABSTRACT

A plurality of flexible and deformable polymeric mat members are utilized and displaced in a plurality of configurations to define a game path. The mat members are consecutively numbered, and wherein the apparatus further includes a plurality of markers, with a variously configured marker for each player utilizing the apparatus. Individuals are directed to throw a marker on each mat in consecutive order, wherein the player is to proceed up and down the path of the numbered markers and pick up the marker on the player's return. The player is to jump over the mat occupied by the marker. A modification of the invention includes the marker with a magnet positioned therewithin, and each mat formed with plural parallel rows of magnets, wherein each adjacent magnet is of a reversed polarity to further require enhanced skill in positioning a marker onto a mat when thrown.

1 Claim, 5 Drawing Sheets

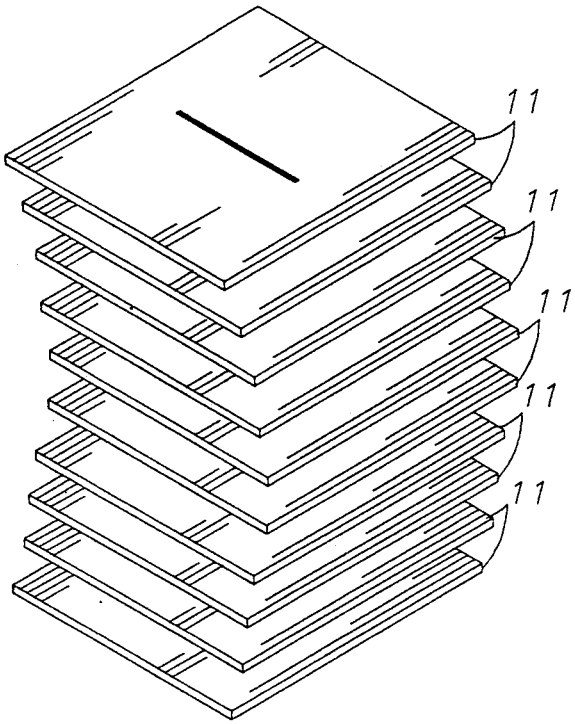
Fig 1
Fig 2
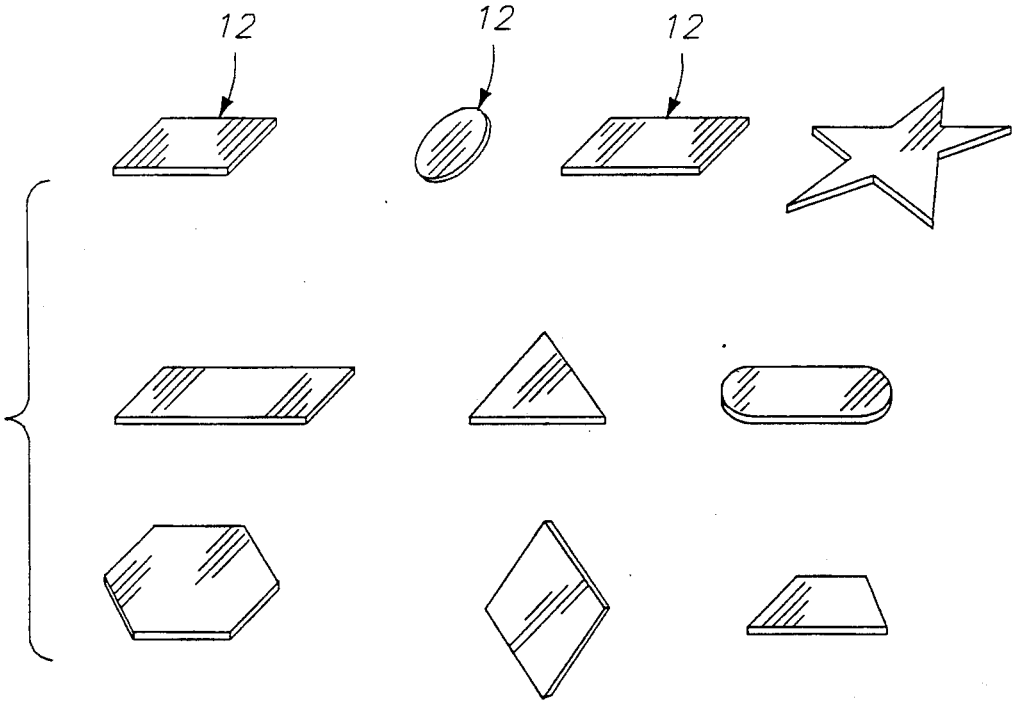

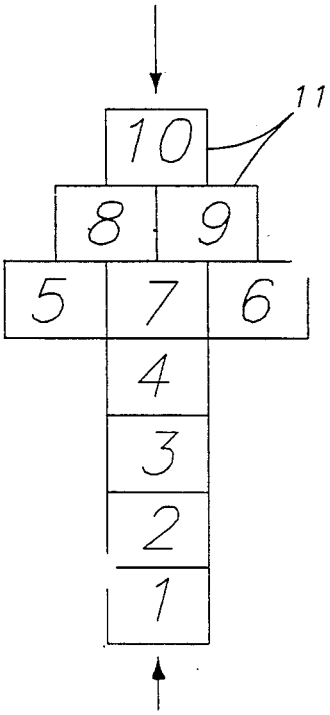
Fig 3
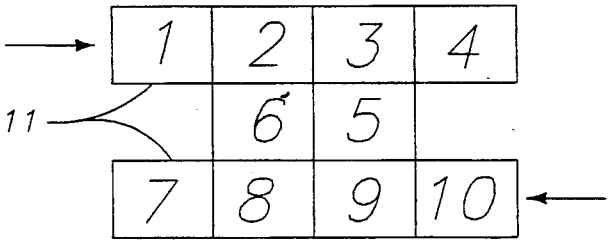
Fig 4
Fig 6
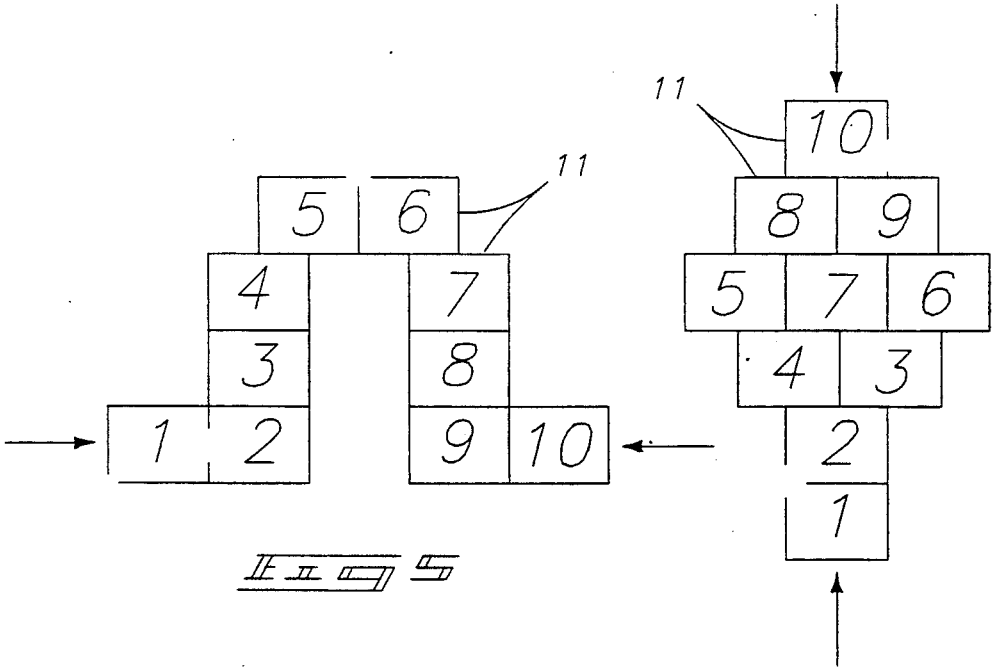
Fig 5

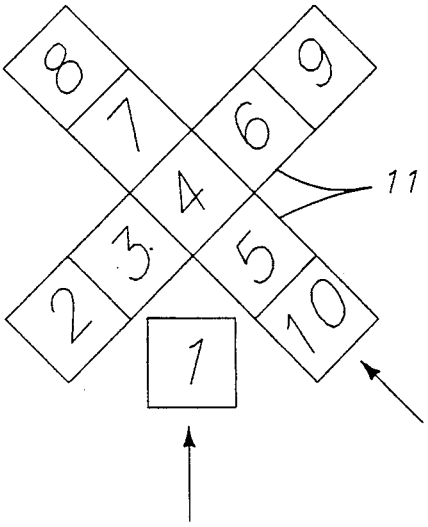
Fig 7
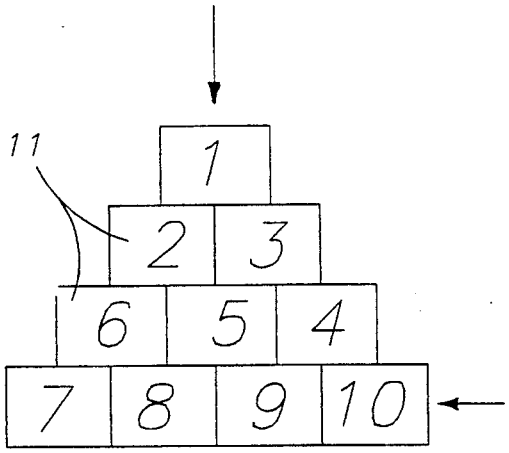
Fig 8
Fig 9
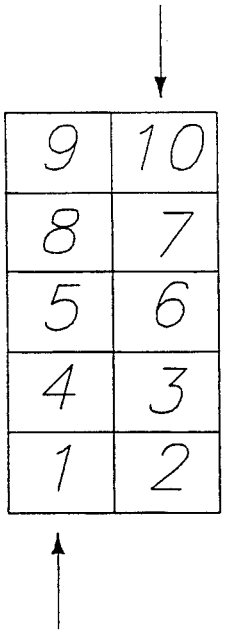
Fig 10
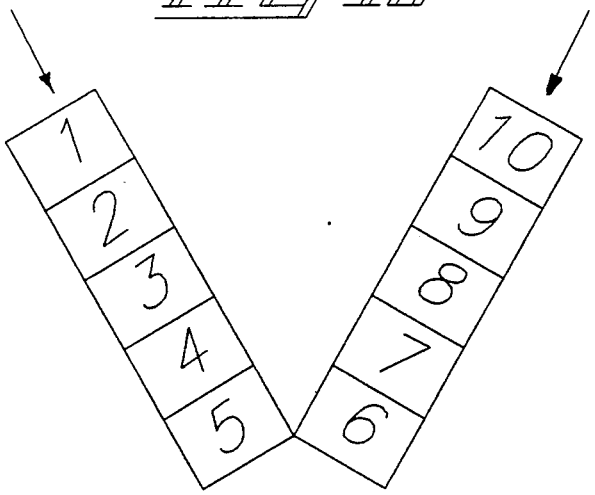

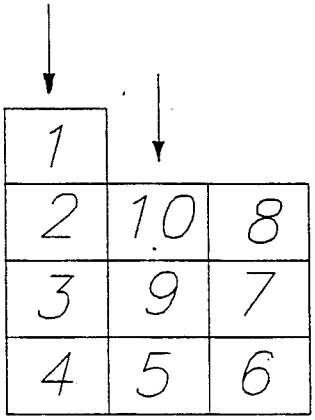
Fig 11
Fig 12
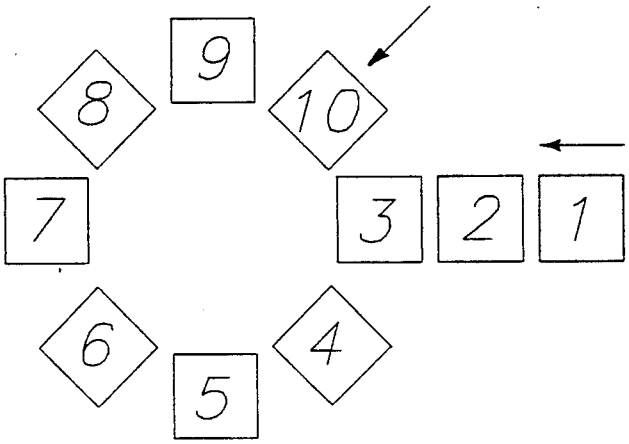
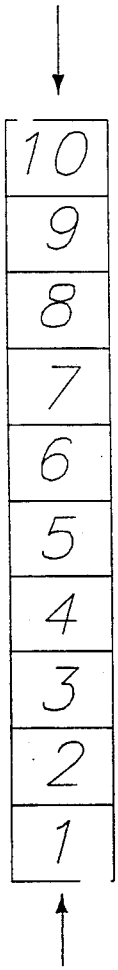
Fig 13
Fig 14
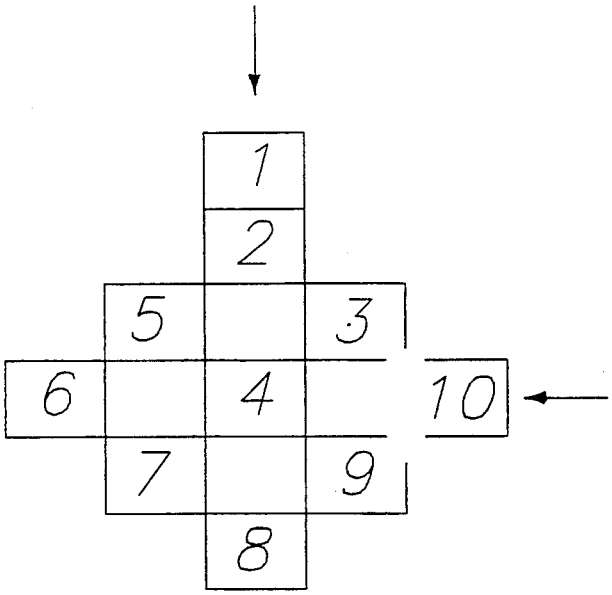

GAME APPARATUS

BACKGROUND OF THE INVENTION

1. Field of the Invention

The field of invention relates to game apparatus, and more particularly pertains to a new and improved jumping game apparatus wherein the same is arranged to permit individuals to form whatever pattern is desired and subsequently proceed along the game path thusly formed.

2. Description of the Prior Art

Various game apparatus has been utilized in the prior art for entertainment and amusement of individuals. Such apparatus is formed for the play and amusement to include such hopscotch games to direct players into markers. A prior art device utilizing a modular construction hopscotch court is set forth in U.S. Pat. No. 3,515,385 to Gunderson wherein the modular hopscotch court utilizes contiguously positioned squares securable together to form a pattern.

U.S. Pat. No. 4,185,819 to Hartley sets forth a hopscotch game utilizing a flexible inflatable plastic framework interconnected to define the path of the hopscotch game.

U.S. Pat. No. 3,226,118 to Nehl sets forth a framework for utilization as a game apparatus, wherein the framework is selectively securable together.

U.S. Pat. No. 3,768,809 to Ciarfello sets forth a playing field, wherein the field utilizes flexible strips of uniformly spaced apertures utilizing interlocking strips to secure the components together for forming a designed field.

As such, it may be appreciated that there continues to be a need for a new and improved game apparatus as set forth by the instant invention which addresses both the problems of ease of use as well as effectiveness in construction in providing a hopscotch game of skill and entertainment and in this respect, the present invention substantially fulfills this need.

SUMMARY OF THE INVENTION

In view of the foregoing disadvantages inherent in the known types of hopscotch game organizations now present in the prior art, the present invention provides a game apparatus wherein the same utilizes a hopscotch type game to permit positioning of various game fields by utilizing individual flexible adherable mats. As such, the general purpose of the present invention, which will be described subsequently in greater detail, is to provide a new and improved game apparatus which has all the advantages of the prior art game apparatus and none of the disadvantages.

To attain this, the present invention provides a plurality of flexible and deformable polymeric mat members utilized and displaced in a plurality of configurations to define a game path. The mat members are consecutively numbered, and wherein the apparatus further includes a plurality of markers, with a variously configured marker for each player utilizing the apparatus. Individuals are directed to throw a marker on each mat in consecutive order, wherein the player is to proceed up and down the path of the numbered markers and pick up the marker on the player's return. A modification of the invention includes the marker with a magnet positioned therewithin, and each mat formed with plural parallel rows of magnets, where each adjacent magnet is of a reversed polarity to further require enhanced skill in positioning a marker onto a mat when thrown.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game apparatus which has all the advantages of the prior art game apparatus and none of the disadvantages.

It is another object of the present invention to provide a new and improved game apparatus which may be easily and efficiently manufactured and marketed.

It is a further object of the present invention to provide a new and improved game apparatus which is of a durable and reliable construction.

An even further object of the present invention is to provide a new and improved game apparatus which is susceptible of a low cost of manufacture with regard to both materials and labor, and which accordingly is then susceptible of low prices of sale to the consuming public, thereby making such game apparatus economically available to the buying public.

Still yet another object of the present invention is to provide a new and improved game apparatus which provides in the apparatuses and methods of the prior art some of the advantages thereof, while simultaneously overcoming some of the disadvantages normally associated therewith.

Still another object of the present invention is to provide a new and improved game apparatus wherein the same utilizes flexible adherable mats positionable about a surface to form various patterns and playing fields, and further provide such mats with a matrix of encased magnets of varying orientations of polarity cooperating with a magnet within a game throwing marker to require additional skill and interest in playing of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the flexible and deformable mat members utilized by the instant invention.

FIG. 2 is an isometric illustration illustrating the various throwing markers utilized by the instant invention.

FIGS. 3–14 illustrate typical game fields assembled by utilizing the mat members of the instant invention.

DESCRIPTION OF THE PREFERRED EMBODIMENT

Figure 15:
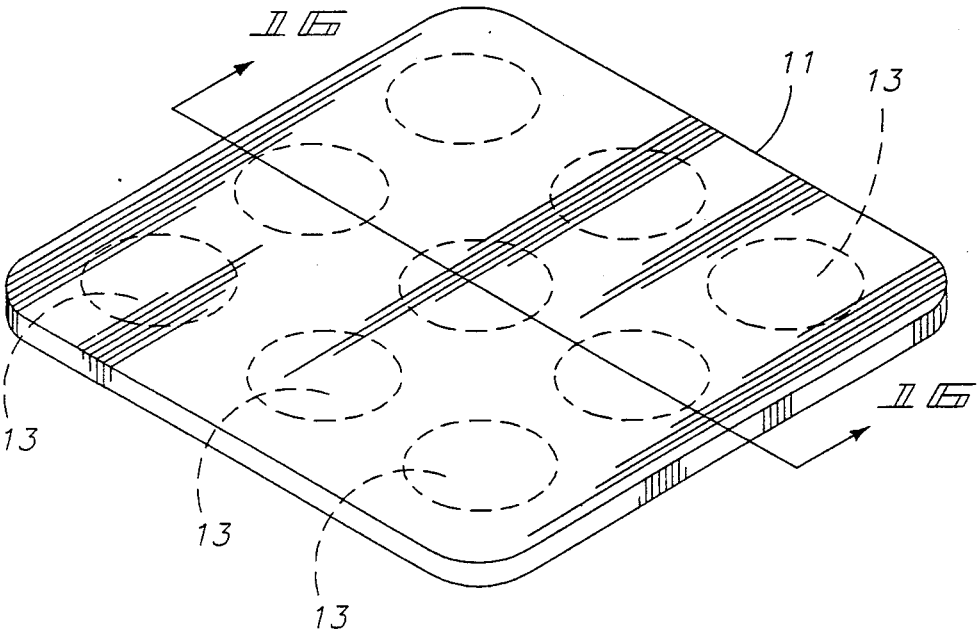
FIG. 15 is an isometric illustration of a modified mat member utilized by the instant invention.

With reference now to the drawings, and in particular to FIGS. 1 to 17 thereof, a new and improved game apparatus embodying the principles and concepts of the present invention and generally designated by the reference numerals 11–18 will be described.

More specifically, the game apparatus of the invention essentially comprises a plurality of flexible and deformable polymeric mat members 11 consecutively numbered from 1–10, wherein FIG. 1 illustrates one of such mat members, wherein each of the members are equally configured of a generally rectangular configuration, with consecutive digits imparted thereon, in a manner as illustrated in FIGS. 3–14. The mat members are of a memory retentent material, and are adherable to an underlying surface. In formation of the various game fields, as illustrated in FIGS. 3–14, the mat members are oriented in any desired pattern, but spacing between an adjacent mat member is not to exceed a width of any individual of the mat members. Each player of a plurality of players is provided a throwing marker 12 of the variously configured markers, as illustrated in FIG. 2. The markers are variously configured to prevent confusion between players, whereupon each player in turn attempts to ascend and descend the consecutively numbered mats in a playing field directed from 1–10, and then back through the field from 10-1 by consecutively and in attended successful throwing and traverse of the field utilizing a marker. In playing of the game, a marker is directed onto the mat members in consecutive order, whereupon a player must hop over a marker when the players ascend through numbered mat members and then upon the player's return and descent through the consecutively numbered mat members, picks up that player's marker while again hopping over the associated mat member containing the marker. Only one foot of a player may be represented in each block. If an associated foot touches the underlying ground, that player loses a turn. A turn is also lost when a jump is unsuccessfully negotiated. A player to traverse the mat members 11 in ascent and descent through the consecutively digited numbers is declared a winner.

Figure 16:
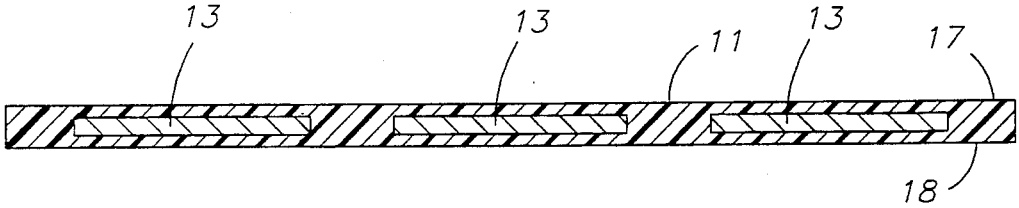
FIG. 16 is an orthographic view, taken along the lines 16—16 of FIG. 15 in the direction indicated by the arrows.
Figure 17:
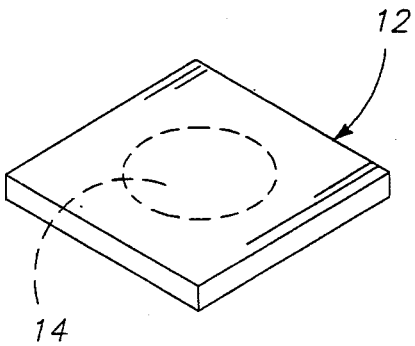
FIG. 17 is an isometric illustration of a throwing marker utilized by the instant invention for cooperation with the modified mat member of FIG. 15 and FIG. 16.

FIGS. 15 and 16 illustrate a modified mat member structure that is utilized to enhance risk and require additional skill in correctly directing and positioning a throwing marker 12 onto an associated mat member 11. The mat members 11 are accordingly formed with first magnet members 13 defining a plurality of rows of equally spaced magnets. The magnets are of a ferromagnetic permanent magnet type, wherein adjacent magnets of each of the magnets in the matrix of magnets imbedded within the mat member are of a reverse polarity. For example, the mat members includes a member top surface and mat member bottom surface 18. A first magnet may have a North/South orientation of its polarity directed to the respective top and bottom surfaces 17 and 18. Adjacent magnet members will have reverse polarity directing the North/South polarity to the bottom and top surfaces 18 and 17 respectively. The throwing marker 12, as illustrated in FIG. 17, will contain a second magnet 14, with its polarity directed to a top and bottom surface of the throwing marker 12. Upon projecting a marker 12 onto an associated mat member 11, the second magnet member 14 whose polarity is reversed relative to a receiving magnet of the first magnet members 13 will deflect the throwing marker, whereupon the marker may in turn be adhered to an adjacent magnet or be projected from the mat member forcing that player to lose a turn. Accordingly, additional risk and entertainment is afforded in utilizing the structures as set forth in FIGS. 15–17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hopscotch game apparatus, comprising in combination, a predetermined plurality of flexible and deformable mat members each mat member of the plurality of mat members is consecutively numbered and is formed of an adherable memory retentent polymeric material, and the mat members are positioned upon a playing surface in a predetermined and selective pattern spaced apart a distance not to exceed a predetermined width defined by each of said mat members, and further including a plurality of throwing markers, each of the throwing markers formed of a variously configured geometric configuration to distinguish adjacent markers relative to one another, and wherein each mat member includes a plurality of first magnet members, each of the first magnet members is imbedded within each of the mat members, and each of the mat members defines a planar top surface spaced from a planar bottom surface, and each of the magnet members of the plurality of magnet members defines a plurality of rows of equally spaced magnets, and each of the first magnet members of the plurality of magnet members is formed of a reverse polarity relative to an adjacent first magnet member of the plurality of first magnet members, and each magnetic polarity is orthogonally oriented relative to the mat member top surface and the mat member bottom surface, and each throwing marker of the plurality of throwing markers includes a marker top surface and a marker bottom surface, and each of the throwing markers includes a second single magnet, wherein the second magnet is orthogonally oriented relative to the throwing marker top surface and the throwing marker bottom surface.

* * * * *